US009091981B2

(12) United States Patent
Aoki

(10) Patent No.: US 9,091,981 B2
(45) Date of Patent: Jul. 28, 2015

(54) IMAGE HEATING APPARATUS

(71) Applicant: CANON KABUSHIKI KAISHA, Tokyo (JP)

(72) Inventor: Kohei Aoki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 13/867,359

(22) Filed: Apr. 22, 2013

(65) Prior Publication Data

US 2013/0279956 A1 Oct. 24, 2013

(30) Foreign Application Priority Data

Apr. 24, 2012 (JP) ..... 2012-098677

(51) Int. Cl.
*G03G 15/20* (2006.01)

(52) U.S. Cl.
CPC ..... *G03G 15/2064* (2013.01)

(58) Field of Classification Search
CPC ..... G03G 15/2025; G03G 15/2075
USPC ..... 399/324, 329
See application file for complete search history.

(56) References Cited

U.S. PATENT DOCUMENTS

| | | | | |
|---|---|---|---|---|
| 7,539,449 | B2 | 5/2009 | Aoki | |
| 7,831,188 | B2 * | 11/2010 | Lee | 399/329 |
| 2008/0317526 | A1 * | 12/2008 | Fujimori et al. | 399/329 |
| 2012/0113204 | A1 * | 5/2012 | Tanaka et al. | 347/104 |
| 2012/0328338 | A1 | 12/2012 | Nawa et al. | |
| 2012/0328342 | A1 | 12/2012 | Takematsu et al. | |
| 2013/0084102 | A1 | 4/2013 | Fukuda et al. | |
| 2013/0094887 | A1 | 4/2013 | Nawa et al. | |

FOREIGN PATENT DOCUMENTS

JP 11-45016 A 2/1999

OTHER PUBLICATIONS

Machine Translation of JP H11-45016 A.*

* cited by examiner

*Primary Examiner* — Gregory H Curran
(74) *Attorney, Agent, or Firm* — Fitzpatrick, Cella, Harer & Scinto

(57) ABSTRACT

An image heating apparatus includes an endless belt for heating an image on a sheet in a nip; a supporting roller for rotatably supporting the endless belt; a displacing mechanism for displacing the supporting roller so as to maintain the endless belt in a predetermined zone in a widthwise direction; an electrical discharging member for electrically discharging the endless belt; and a holding member for holding the electrical discharging member so as to displace together with the supporting roller.

3 Claims, 11 Drawing Sheets

(a)

(b)

(a)

(b)

IMAGE HEATING APPARATUS

FIELD OF THE INVENTION AND RELATED ART

The present invention relates to an image heating apparatus for heating an image on a sheet of recording medium. An image heating apparatus is employed by such an image forming apparatus as a copying machine, a printer, a facsimile machine, etc. It is also employed by a multifunction image forming apparatus, that is, an image forming apparatus capable of functioning as two or more of the preceding image forming apparatuses.

Generally, a fixing device (image heating apparatus) is structured so that a toner image formed on a sheet of recording medium through an electrophotographic process is fixed to the sheet by the application of heat and pressure to the sheet and the toner image thereon.

One of the fixing devices such as the one described above is disclosed in Japanese Laid-open Patent Application H11-45016. This fixing device employs a fixation belt (endless belt). In the case of a fixing belt such as the one disclosed in the abovementioned patent application, it is possible for the fixation belt to unwantedly shift in its widthwise direction. Thus, it is desired that a fixing device is controlled in terms of the unwanted shift of its fixation belt in the widthwise direction of the belt.

One of the known methods for controlling the widthwise shifting of the fixation belt is to displace (tilt) the roller which supports the fixation belt so that the belt is allowed to circularly move.

Another issue which concerns a fixation belt is that while a toner image on a sheet of recording medium is fixed, the fixation belt tends to become frictionally charged. As the fixation belt becomes frictionally charged, it is possible that the toner of which a toner image is formed will be attracted to the fixation belt, and therefore, it will become impossible for the fixing device to properly fix the toner image.

Thus, in the case of the fixing device disclosed in Japanese Laid-open Patent Application H11-45016, a means for removing electrical charge (which hereafter may be referred to simply as discharging member) from the fixation belt is positioned in the adjacencies of the fixation belt.

However, in a case where a fixing device is structured as disclosed in the aforementioned patent application, as the fixation belt is controlled in its widthwise shift, the gap between the fixation belt and discharging member changes, which possibly makes it difficult for the discharging member from properly removing the electrical charge from the fixation belt.

SUMMARY OF THE INVENTION

Thus, the primary object of the present invention is to provide an image heating apparatus capable of keeping its endless belt free of electrical charge.

According to an aspect of the present invention, there is provided an image heating apparatus comprising an endless belt for heating an image on a sheet in a nip; a supporting roller for rotatably supporting said endless belt; a displacing mechanism for displacing said supporting roller so as to maintain said endless belt in a predetermined zone in a widthwise direction; an electrical discharging member for electrically discharging said endless belt; and a holding member for holding said electrical discharging member so as to displace together with said supporting roller.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

[Embodiment 1]

(1) Image Forming Apparatus

Figure 15:
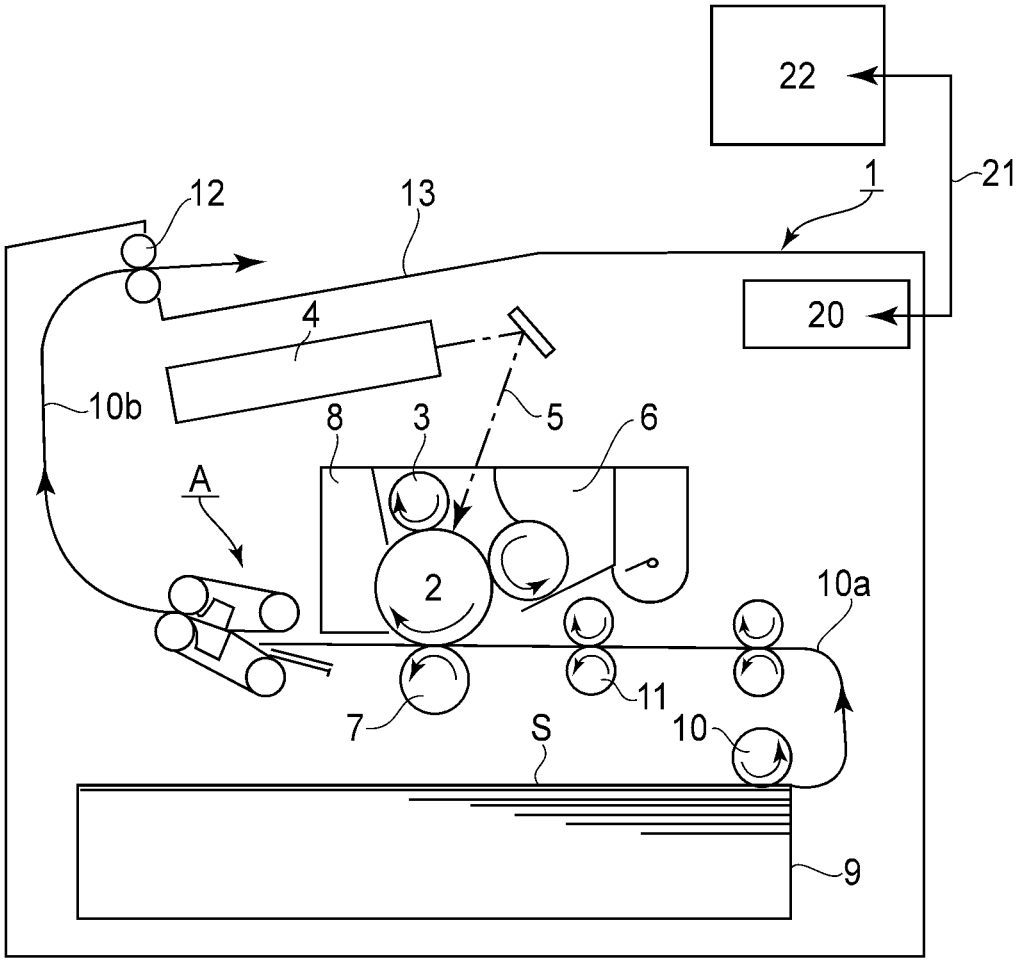
FIG. 15 is a schematic sectional view of a typical image forming apparatus to which the present invention is applicable.

FIG. 15 is a schematic sectional view of a typical image forming apparatus which has a fixing device A in accordance with the present invention, which functions as an image forming device. It shows the general structure of the apparatus.

This image forming apparatus 1 is an electrophotographic printer (which hereafter will be referred to simply as printer). The control portion 20 (CPU) of this printer 1 is in connection to an external host apparatus 22 through an interface 21. The printer 1 can form an image, which reflects the image formation data (electrical information of image to be formed) inputted from the external host apparatus 22, on a sheet S of recording medium, and output the combination of the sheet S and the toner image thereon, as a print.

The control portion 20 is a controller which integrally controls the various operations of the printer 1. It exchanges various electrical information with the external host apparatus 22 and the control panel (unshown) of the printer 1. Further, it controls the processing of electrical information inputted from the various processing devices and sensors (belt shift sensor, for example, which will be described later) of the printer 1, processing of the command signals to be outputted to the various processing devices, preset initial sequence, and preset image formation sequence. The external host apparatus 22 is a personal computer, a network, an image reader, a facsimile machine, or the like.

The printer 1 can be roughly divided into an electrophotographic image forming portion (image forming means) and a fixing device. The image forming portion forms an unfixed toner image and places the toner image on a sheet S of recording medium. The fixing device fixes the unfixed toner image formed on the sheet S, to the sheet S by applying heat and pressure to the sheet S and the unfixed toner image thereon. That is, it turns the unfixed toner image into a permanent image.

The electrophotographic image forming portion is provided with a photosensitive drum 2 (which hereafter may be referred to simply as drum) as an image bearing member which bears a latent image. The drum 2 is rotationally driven in the clockwise direction indicated by an arrow mark, at a preset speed. As the drum 2 is rotationally driven, its peripheral surface is uniformly charged to a preset polarity and potential level by a charging device 3.

Then, the uniformly charged portion of the peripheral surface of the drum 2 is scanned by (exposed to) a beam 5 of laser light emitted by a laser scanner 4 (exposing device) while being modulated with the information of the image to be formed. As a result, an electrostatic latent image, which reflects the information of the image to be formed, with which the beam 5 of laser light is modulated, is effected on the peripheral surface of the drum 2. Then, the electrostatic latent image is developed into a visible image, more specifically, an image formed of toner (toner image, hereafter), by a developing device 6.

The toner image is electrostatically transferred from the drum 2 onto a sheet S of recording medium, in the transfer station of the image forming portion, which is the area of contact between the drum 2 and a transfer roller 7. More specifically, as the sheet S is introduced into, and conveyed through the transfer station, the toner image on the drum 2 is transferred onto the sheet S as if it is peeled away from the drum 2. To the transfer roller 7, a preset transfer bias is applied with a preset control timing.

A sheet feeder cassette 9, which is in the bottom portion of the main assembly of the printer 1 can store in layers a substantial number of sheets S of recording medium. As the feed roller 10 of the sheet feeder cassette 9 is driven with a preset sheet feeding timing, the sheets S in the cassette 9 are fed one by one into the main assembly of the printer 1 while being separated from the rest, and are conveyed to a pair of registration rollers 11 through a recording medium conveyance passage 10. If a given sheet S of recording medium is askew when its leading edge reaches the pair of registration rollers 11, it is corrected in attitude by the registration rollers 11. Further, the sheet S is conveyed to the transfer station in synchronism with the progression of the formation of the toner image on the peripheral surface of the drum 2. That is, the registration rollers 11 release the sheets S with such a timing that the leading edge of the toner image on the drum 2 arrives at the transfer station at the same time as the leading edge of the sheet S.

After being conveyed through the transfer station, the sheet S is separated from the drum 2, and is conveyed to the fixing device A, by which the unfixed toner image on the sheet S is fixed, as a permanent image, to the surface of the sheet S by the heat and pressure applied by the fixing device A. Then, the sheet S is conveyed through a sheet conveyance passage 10*b*, and is discharged by a pair of discharge rollers 12, into a delivery tray 13, which is a part of the top wall of the main assembly of the printer 1. After the separation of the sheet S from the drum 2, the residues, such as toner, remaining adhered to the peripheral surface of the drum 2, are removed by a cleaning device 8, so that the peripheral surface of the drum 2 can be repeatedly used for image formation.

(2) Fixing Device A

Figure 1:
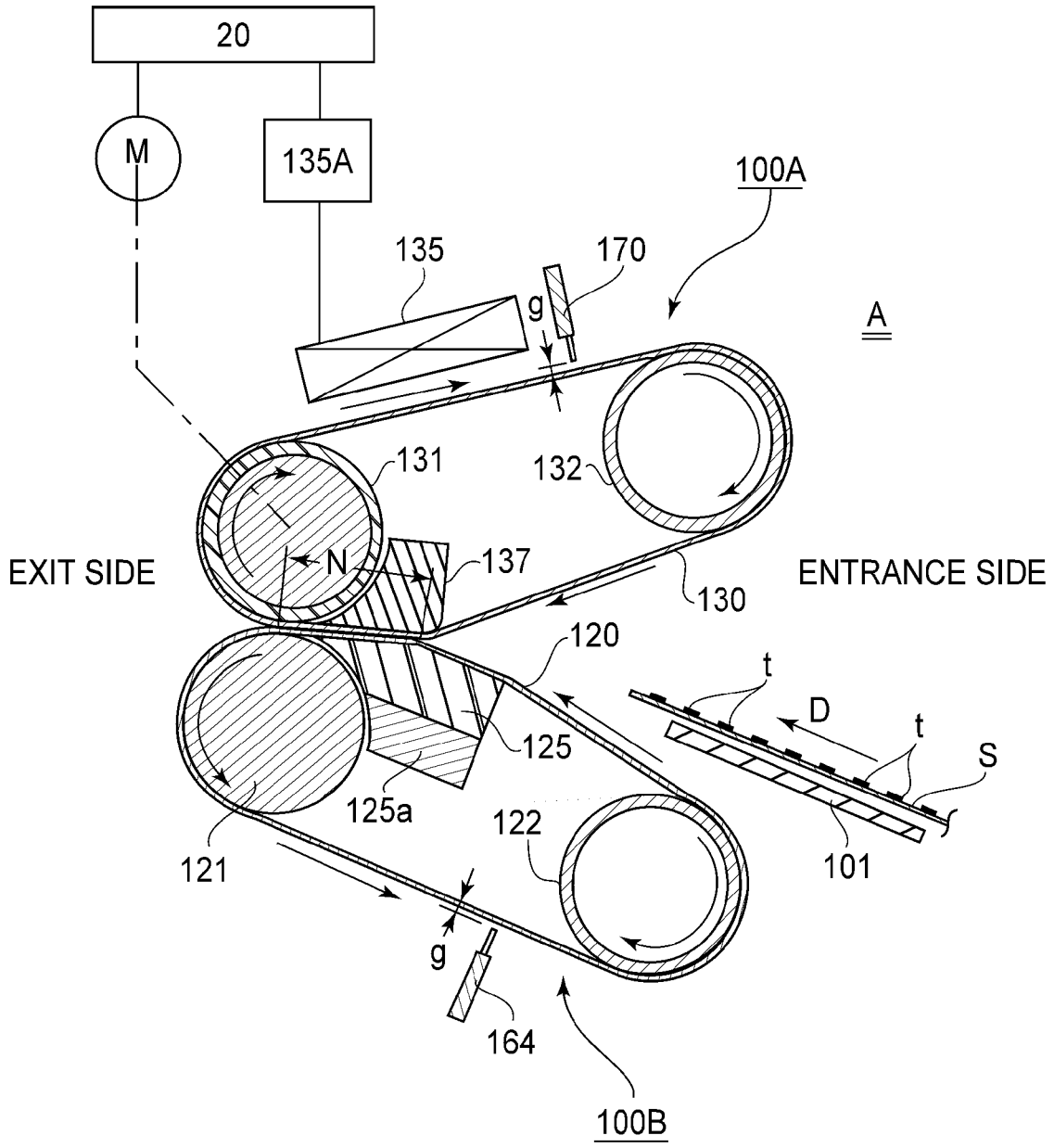
FIG. 1 is a schematic sectional view of the essential portions of the fixing device in the first embodiment of the present invention, at a plane perpendicular to the lengthwise direction of the fixing device, as seen from the right-hand side of the fixing device.

FIG. 1 is a schematic sectional view of the essential portions of the fixing device A, at a plane perpendicular to the lengthwise direction of the device A, as seen from the right-hand side of the device A. In the following description of the embodiments of the present invention, the lengthwise direction of the fixing device A and the structural components thereof (or their measurement) is such a direction that is perpendicular to the sheet conveyance direction D, at the sheet conveyance surface (recording medium conveyance surface) in which the sheet S is conveyed on the sheet conveyance surface. The widthwise direction of the fixing device A and structural components thereof (or their measurement) is such a direction that is parallel to the sheet conveyance direction D.

The front side of the fixing device A is the sheet entrance side of the fixing device A, and the rear side of the fixing device A is the sheet exit side of the fixing device A. The left and right sides of the fixing device A are the left and right sides of the fixing device A as seen from the front side of the fixing device A. In the description of this embodiment, the left side of the fixing device A in the drawings may be referred to as the front side, whereas the right side of the fixing device A in the drawings may be referred to as the rear side of the fixing device A. The top and bottom sides of the fixing device A are the top and bottom sides of the fixing device A in terms of the direction of gravity. Further, the upstream or downstream of the fixing device A is the upstream or downstream of the device A with reference to the direction in which recording medium is conveyed.

The fixing device A, as an image processing device, in this embodiment is of the so-called twin-belt-nip type, electromagnetic induction heating type (IH), and oil-less fixing type.

This fixing device A is provided with a fixation belt unit 100A and a pressure belt unit 100B, which are top and bottom units, respectively, of the device A. The fixation belt 130 of the fixation belt unit 100A, and the pressure belt 120 of the pressure belt unit 100B, are kept pressed upon each other to form a fixation nip N between the two belts 120 and 130.

A sheet S of recording medium which is bearing an unfixed toner image t is conveyed through the fixation nip N, while being kept pinched between the fixation belt 130 and pressure belt 120. As the sheet S is conveyed, the unfixed toner image on the sheet S is fixed to the sheet S, becoming a permanent toner image, by the heat from the fixation belt 130 which is being heated by electromagnetic induction, and the pressure generated in the fixation nip N by the pressure belt unit 100B.

(2-1) Fixation Belt Unit 100A

The fixation belt unit 100A has the fixation belt 130 (endless belt), as a circularly movable heating means, which is flexible. It has also multiple rollers by which the fixation belt 130 is supported, and kept tensioned, in such a manner that the fixation belt 130 is circularly movable. More concretely, the fixation belt unit 100A has a driver roller 131, and a steering roller which functions also as a tension roller. Further, it has a stay 137 (pressure pad) which backs up the fixation belt 130 against the pressure belt unit 100B, an induction heating coil 135 for heating the fixation belt 130 by electromagnetic induction, a discharging needle 170 for ridding the fixation belt 130 of electrical charge, etc.

There is no restriction with respect to the material and structure of the fixation belt 130, as long as the fixation belt 130 can be heated by magnetic induction heating coil 135 and is heat resistant. For example, an endless belt which is made up of a layer of magnetic metal, such as nickel or stainless, is 75 μm in thickness, 380 mm in width, and 300 mm in length (circumferential length), a silicone rubber layer which is coated on the outward surface of the metallic layer to a thickness of 300 μm, for example, and a surface layer (piece of PFA tube) which covers the outward surface of the silicone rubber layer, may be used as the fixation belt 130.

The driver roller 131 is rotatably supported in the fixing device A, on the sheet outlet side of the fixing device A. The driver roller 131 in this embodiment is a solid roller which is made up of stainless steel and is 18 mm in external diameter, and an elastic layer which is molded on the peripheral surface of the metallic core, of heat resistant silicone rubber, and is 1 mm in thickness.

The tension roller 132 is rotatably supported in the fixing device A, on the sheet entrance side of the fixing device A. It is kept pressured by a tension generating mechanism (which will be described later) in the direction to provide the fixation belt 130 with a preset amount of tension. Further, it can be changed in its attitude relative to the driver roller 131 (belt supporting other member), as a member which is movable in an oscillatory manner, by the steering mechanism (attitude changing mechanism), which will be described later. With the fixing device A being structured as described above, it is possible to control the fixation belt 130 in its movement in the direction parallel to the axial line of the driver roller 131, which occurs while the fixation belt 130 is circularly moved. That is, the fixation belt 130 is controlled by the steering mechanism in such a manner that when it is circularly moved, it remains in a preset range in terms of its widthwise direction.

The stay 137 is made of stainless steel, for example. It is placed in the inward side of the loop which the fixation belt 130 forms. It is placed between the driver roller 131 and steering roller 132. More specifically, it is positioned next to the driver roller 131, with its belt backing surface facing downward.

The fixation belt 130 is suspended by the driver roller 131, tension roller 132, and belt backing stay 137, being tensioned by a preset amount of force applied to the tension roller 132 by the belt tensioning mechanism in the direction to provide the fixation belt 130 with a preset amount of tension. The downwardly facing surface of the belt backing stay 137 remains in contact with the inward surface of the fixation belt 130, in terms of the belt loop, across the portion of the belt 130, which is moving through the bottom portion of the belt loop.

(2-2) Pressure Belt Unit 100B

The pressure belt unit 100B has the pressure belt 120 (endless belt), as a circularly movable pressure applying means, which is flexible. It has also multiple rollers by which the pressure belt 120 is supported so that the pressure belt 120 is circularly movable. More concretely, the pressure belt unit 100B has a pressure roller 121, and a steering roller 122 which functions as a tension roller. Further, it has a pressure pad 125 which keeps the pressure belt 120 pressured toward the fixation belt unit 100A, a discharging needle 164 for ridding the pressure belt 120 of electrical charge, etc.

There is no restriction with respect to the material and structure of the pressure belt 120, as long as the pressure belt 120 can be heat resistant. For example, an endless metallic belt which is made of nickel, for example, is 50 μm in thickness, 380 mm in width, and 200 mm in length (circumferential length), a silicone rubber layer which is coated on the outward surface of the metallic belt to a thickness of 300 μm, for example, and a surface layer (piece of PFA tube) which covers the outward surface of the silicone rubber layer, may be used as the pressure belt 120. The electrical resistance of the surface layer of the pressure belt 120 in this embodiment is in a range of $10^9$-$10^{11}$Ω.

The pressure roller 121 is rotatably supported in the fixing device A, on the sheet outlet side of the fixing device A. The pressure roller 121 in this embodiment is a solid roller which is made up of stainless steel and is 20 mm in external diameter.

The tension roller 122 is rotatably supported in the fixing device A, on the sheet entrance side of the fixing device A. It is kept pressured by a tension generating mechanism (which will be described later) in the direction to provide the pressure belt 120 with a preset amount of tension. Further, the tension roller 122 be changed in its attitude relative to the pressure roller 121 (belt supporting other member), as a member which is movable in an oscillatory manner, by the steering mechanism (attitude changing mechanism), which will be described later. With the pressure belt unit 100B being structured as described above, it is possible to control the pressure belt 120 in its movement in the direction parallel to the axial line of the pressure roller 121, which occurs while the pressure belt 120 is circularly moved. That is, the pressure belt 120 can be controlled by the steering mechanism in such a manner that when it is circularly moved, it remains in a preset range in terms of its widthwise direction.

The pressure pad 125 is an elastic pad formed of silicone rubber, for example. It is held to a metallic base 125*a* of the pressure pad 125, and is placed in the inward side of the loop which the pressure belt 120 forms. It is placed between the pressure roller 121 and steering roller 122. More specifically, it is positioned next to the pressure roller 121, with its belt backing surface facing upward.

The pressure belt 120 is suspended by the pressure roller 121, tension roller 122, and pressure pad 125. It is kept tensioned by a preset amount of force applied to the tension roller 122 by the belt tensioning mechanism in the direction to provide the pressure belt 120 with a preset amount of tension. The upwardly facing surface of the pressure pad 125 remains in contact with the inward surface of the pressure belt 120, in terms of the belt loop, across the portion of the belt 120, which is moving through the top portion of the belt loop.

In this embodiment, the pressure belt unit 100B is kept pressed upon the fixation belt unit 100A by 400 N of pressure generated by a pressure application mechanism (unshown). Thus, the pressure roller 121 is kept pressed against driver roller 131 with the presence of the pressure belt 120 and fixation belt 130 between the two rollers 121 and 131. The elastic layer of the driver roller 131 is kept elastically deformed, in the nip N between the driver roller 131 and pressure roller 121, by a preset amount, by the pressure applied by the pressure roller 121.

Therefore, the fixation nip N, which has a preset width in terms of the recording medium conveyance direction D, is formed, and maintained, between the fixation belt 130 and pressure belt 120.

(2-3) Fixing Operation

The driver roller 131 is rotationally driven at a preset peripheral velocity in the clockwise direction indicated by an arrow mark, by the driving force transmitted to the driver roller 131 from a fixation motor M, which is under the control of the control portion 20, through a driving force transmission mechanism (unshown). By this rotation of the driver roller 131, the fixation belt 130 is circularly moved in the clockwise direction indicated by the arrow mark at the speed which corresponds to that of the driver roller 131. The steering roller 132 is rotated by the circularly movement of the fixation belt 130, with the portion of the fixation belt 130, which is moving through the bottom portion of the belt loop, sliding on the downwardly facing surface of the belt backing stay 137.

In order to ensure that a sheet S of recording medium is reliably conveyed through the fixation nip N, it is ensured that the rotational of the driver roller 131 is reliably transmitted to the fixation belt 130. Further, the driving force from the fixation nip N is also transmitted to the pressure roller 121 through the driving force transmission mechanism (unshown), whereby the pressure roller 121 is rotationally driven in the counterclockwise direction indicated by an arrow mark. By this rotation of the pressure roller 121 along with the friction between the rotating fixation belt 130 and pressure roller 121, the pressure belt 120 is circularly moved in the counterclockwise direction indicated by the arrow mark. The fixation belt 130 and pressure belt 120 are the same in their moving speed in the fixation nip N, and are roughly the same in the moving direction in the fixation nip N.

As the induction heating coil 135 is supplied with electric power by an electric power source 135A which is under the control of the control portion 20, it generates an alternating magnetic field, which heats the circularly moving fixation belt 130 by magnetic induction. The temperature of the fixation belt 130 is detected by a thermistor (temperature detecting means: unshown), and the information regarding the temperature of the fixation belt 130 is inputted into the control portion 20. Based on the inputted information regarding the temperature of the fixation belt 130, the control portion 20 controls the electric power supply to the induction heating coil 135 to increase the temperature of the fixation belt 130 to a preset target level, and keep it at the target level.

As soon as the peripheral velocity of the fixation belt 130 and pressure belt 120 reach their target level, and the temperature of the fixation belt 130 reaches it target level, after they began to be circularly moved, a sheet S of recording medium, on which an unfixed toner image t has just been formed by the image formation station, is introduced into the fixing device A. As the sheet S is introduced into the fixing device A, it is advanced into the fixation nip N while being guided by an entrance guide 101 which is located at the sheet entrance portion of the fixing device A.

Then, the sheet S is conveyed through the fixation nip N, with its image bearing surface facing the fixation belt 130, and its opposite surface (back surface) from the image bearing surface facing the pressure belt 120, while remaining pinched between the fixation belt 130 and pressure belt 120. While the sheet S is conveyed through the fixation nip N, the unfixed toner image t on the sheet S is fixed to the surface of the sheet S by the heat from the fixation belt 130 and the nip pressure; the unfixed toner image is turned into a permanent image. After being conveyed through the fixation nip N, the sheet S is separated from the surface of the fixation belt 130, and then, is moved out of the fixing device A through the sheet exit of the fixing device A, to be conveyed further.

(2-4) Belt Tensioning Mechanism and Belt Steering Mechanism

Figure 2:
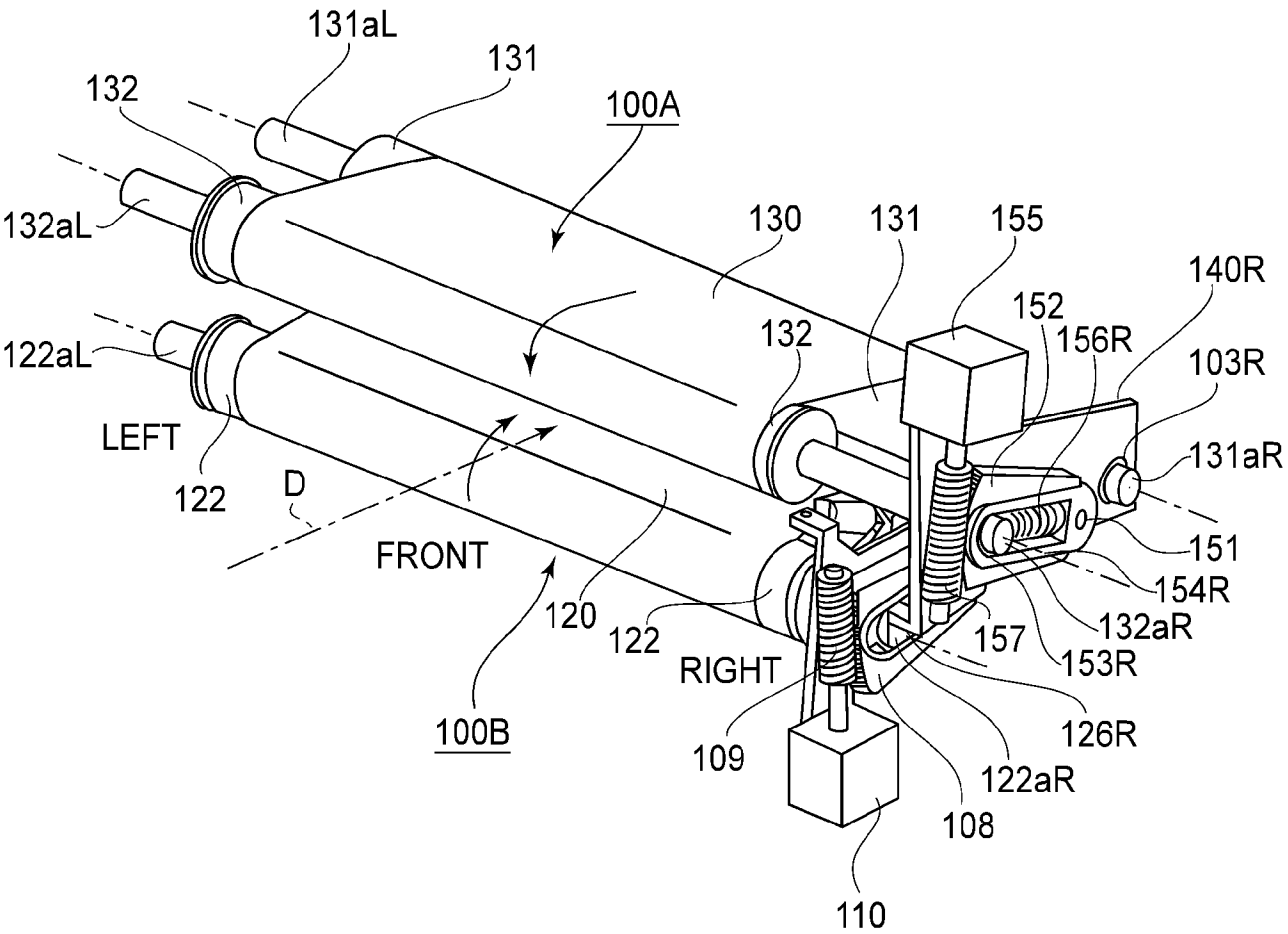
FIG. 2 is a perspective view of the fixing device, shown in FIG. 1, and shows the fixing device driving mechanism, which is on the right-hand side of the device.
Figure 3:
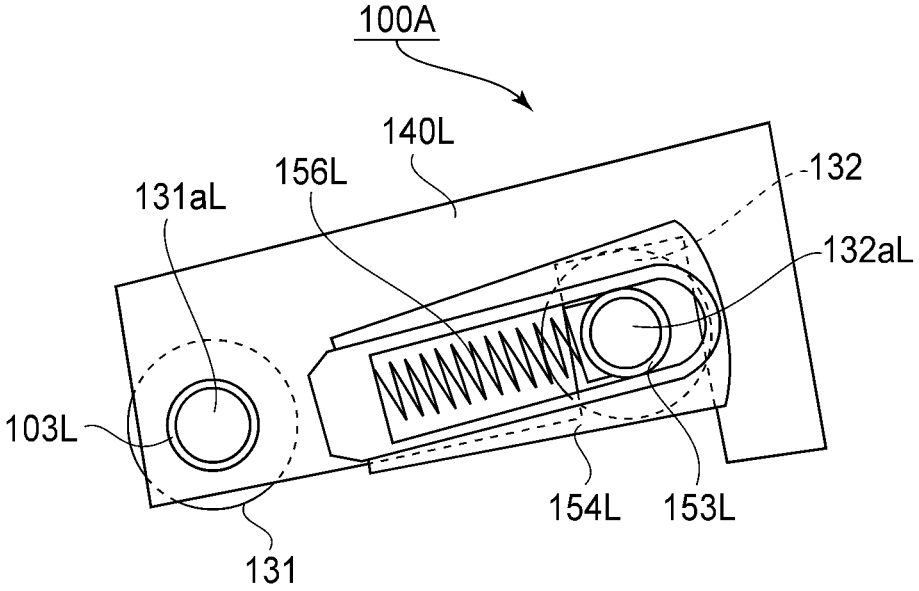
FIGS. 3(*a*) and 3(*b*) are schematic plan views of the left and right ends of the fixation belt unit as seen from the left and right sides, respectively, of the unit.
Figure 3:
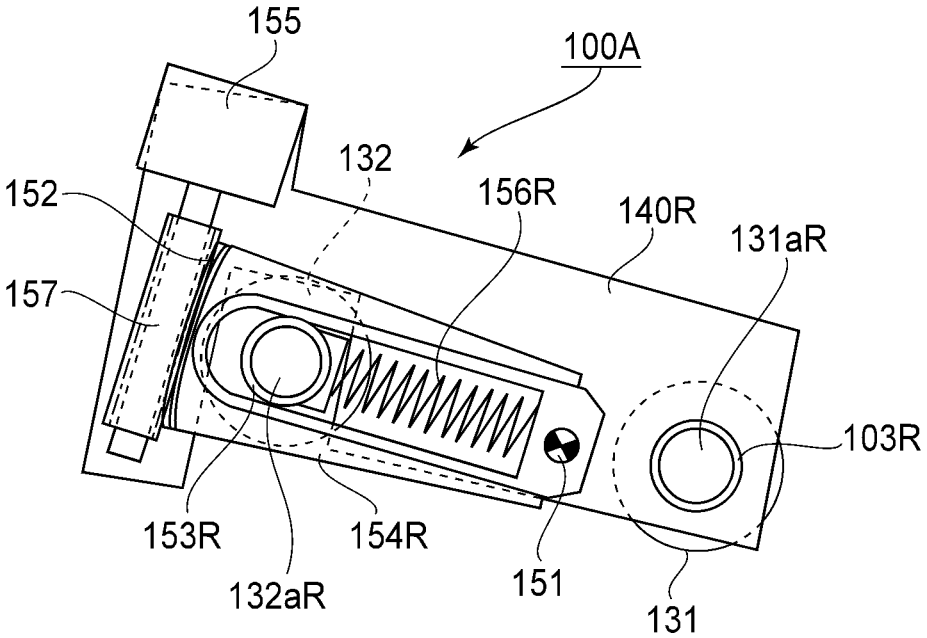
Figure 4:
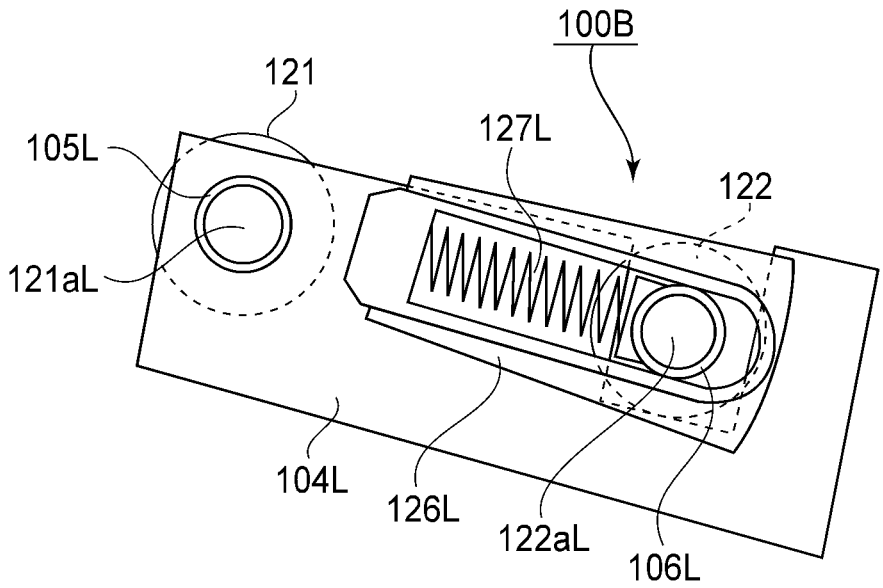
FIGS. 4(*a*) and 4(*b*) are schematic plan views of the left and right ends of the pressure belt unit as seen from the left and right sides, respectively, of the unit.
Figure 4:
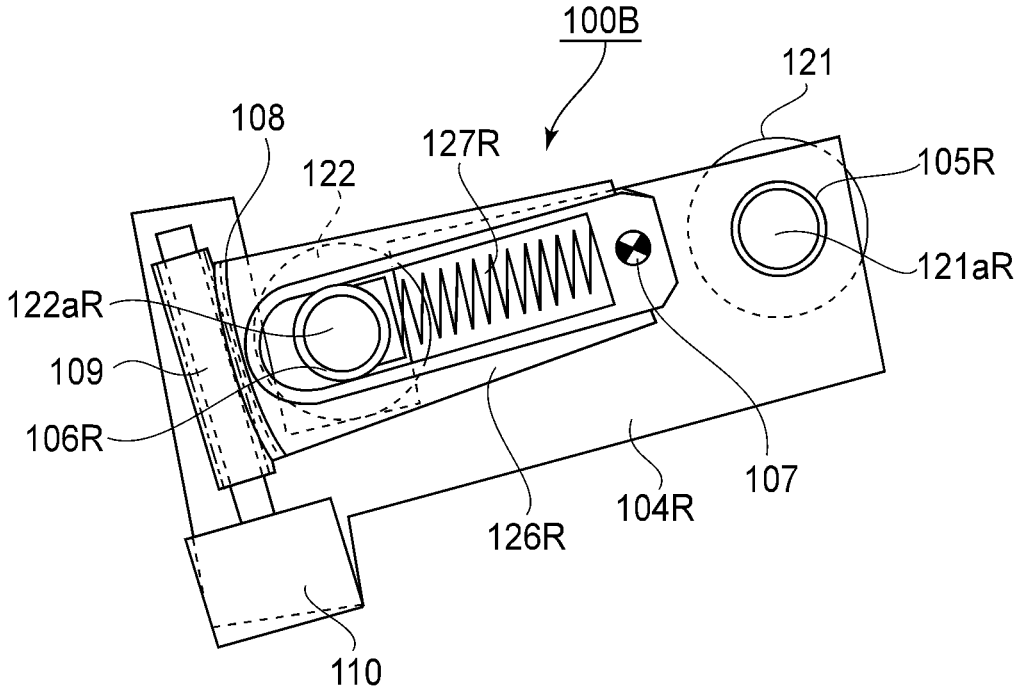

Next, referring to FIGS. 2 and 3, the belt tensioning mechanism of the fixation belt unit 100A and the belt steering mechanism of the fixation belt unit 100A are described. Then, referring to FIGS. 2 and 4, the belt tensioning mechanism of the pressure belt unit 100B and the belt steering mechanism of the pressure belt unit 100B are described. FIG. 2 is a perspective view of the combination of the belt driving mechanism of the fixation belt unit 100A and that of the pressure belt unit 100B, which are on the right-hand end of the fixing device A. FIGS. 3(*a*) and 3(*b*) are plan views of the fixation belt unit 100A as seen from the left and right sides, respectively, of the fixation belt unit 100A. FIGS. 4(*a*) and 4(*b*) are plan views of the pressure belt unit 100B as seen from the left and right sides, respectively, of the unit 100B.

1) Belt Tensioning Mechanism and Belt Steering Mechanism of Fixation belt unit 100A The driver roller 131 of the fixation belt unit 100A is positioned between the top left and top right plates 140L and 140R of the fixing device frame, and is rotatably supported by the left and right plates 140L and 140R, respectively, with the placement of bearings 103L and 103R between the left and right end portions 131*a*L and 131R, respectively, of the shaft 131*a* of the driver roller 131. It should be noted here that FIG. 2 does not show the top left plate 140L of the fixation unit frame.

The fixation belt unit 100A is provided with the steering roller supporting left and right arms 154L and 154R, which are attached to the outward sides of the top left and top right plates 140L and 140R of the fixation unit frame in such a manner that they are symmetrically positioned. These left and right supporting arms 154L and 154R are provided with bearings 153L and 153R, respectively, which are slidable relative to the arms 154L and 154R in the direction of the belt tension. The left and right end portions 132*a*L and 132R of the shaft 132 of the steering roller 132 are rotatably borne by these left and right bearings 153L and 153R, respectively.

The above-described left and right bearings 153L and 153R are kept under a preset amount of pressure generated by the tension springs 156L and 156R in the direction to provide the fixation belt 130 with tension. Thus, the steering roller 132 remains pressed in the direction to keep tensioned the fixation belt 130, whereby the fixation belt 130 always remains under 200 N of tensional force, for example.

The left supporting arm 154L is solidly attached to the top left plate 140L. The right supporting arm 154R is pivotally supported by the top right plate 140R. More specifically, the lengthwise end of the right supporting arm 154R is pivotally supported by a shaft 151 (pivot) attached to the top right plate 140R. Thus, the right supporting arm 154R is allowed to vertically pivot about the shaft 151 (pivot). Further, the opposite end of the shaft 151 from the right support arm 154R is fitted with a sector gear 152, which is in engagement with a worm gear rotatable by a stepping motor 155. The motor 155 is solidly attached to the right top plate 140R.

The motor 155 can be controlled by the control portion 20 so that it rotates forward or in reverse. Thus, as the motor 155 is rotated in the forward or in reverse by the motor 155, the right supporting arm 154R is pivotally moved about the shaft 151 upward or downward by the force conveyed thereto from the motor 155 by way of the worm gear 157 and sector gear 152. That is, the right bearing 153R, by which the right end portion 132*a*R of the shaft 132*a* of the steering roller 132 is borne, is moved upward or downward.

Thus, the steering roller 132 is pivotally moved about the left bearing 153L, by which the end portion 132*a*L of the shaft 132*a* of the steering roller 132, is moved upward or downward. Consequently, the steering roller 132, which functions as an oscillatory roller, is changed in its attitude relative to the driver roller 131. It is by this oscillatory movement of the steering roller 132 that the lateral shift of the fixation belt 130, that is, the movement of the fixation belt 130 in the direction parallel to the axial line of the driver roller 131 (belt supporting member), which occurs while the fixation belt 130 is circularly moved, is controlled.

Figure 5:
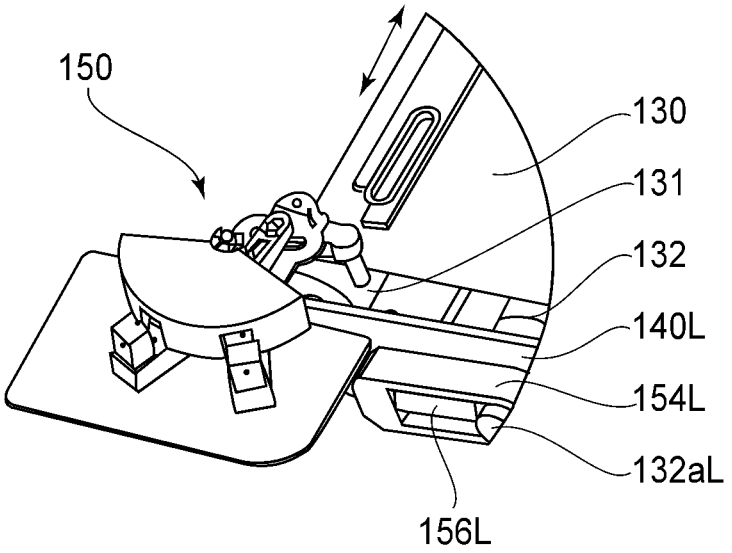
FIG. 5 is a perspective view of the belt shift sensor and its adjacencies.
Figure 6:
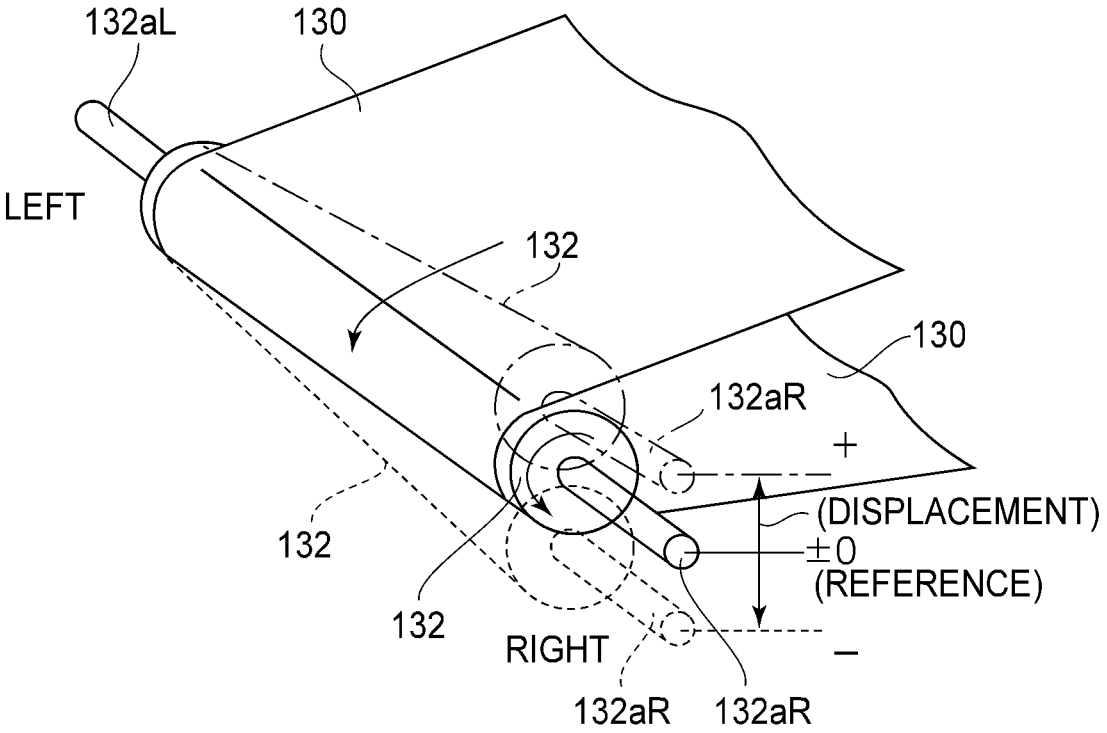
FIG. 6 is a drawing for showing the oscillatory movement of the steering roller.

To describe in more detail, referring to FIG. 5, the fixation belt unit 100A is provided with a belt shift sensor 150 for detecting the position of the fixation belt 130 in terms of the direction perpendicular to the direction of the circular movement of the fixation belt 130. The belt shift sensor 150 is in the adjacencies of the left end portion (front end portion) of the fixation belt 130. The control portion 20 detects the position of one of the lateral edges of the fixation belt 130 with the use of this sensor 150, and controls the fixation belt 130 in position in terms of the direction perpendicular to the circular movement of the fixation belt 130. More specifically, the control portion 20 controls the fixation belt 130 in position by tilting the steering roller 132 as shown in FIG. 6 by rotating the motor 155.

2) Belt Tensioning Mechanism and Belt Steering Mechanism of Pressure Belt Unit 100B The pressure roller 121 of the pressure belt unit 100B is positioned between the left and right bottom plates 104L and 104R of the fixing device frame, and is rotatably supported by the left and right bottom plates 104L and 104R, respectively, with the placement of bearings 105L and 105R between the left and right end portions 121*a*L and 121*a*R, respectively, of the shaft 121*a* of the pressure roller 121. It should be noted here that FIG. 2 does not show the bottom left plate 104L of the fixation device frame.

The pressure belt unit 100B is provided with the steering roller supporting left and right arms 126L and 126R, which are attached to the outward sides of the top left and top right plates 140L and 140R of the fixation device frame in such a manner that they are symmetrically positioned. These left and right supporting arms 126L and 126R are provided with bearings 106L and 106R, respectively, which are slidable relative to the arms 126L and 126R in the direction of the belt tension. The left and right end portions 122*a*L and 122*a*R of the shaft 122 of the pressure roller 121 are rotatably borne by these left and right bearings 106L and 106R, respectively.

The above-described left and right bearings 106L and 106R are kept under a preset amount of pressure generated by the tension springs 127L and 127R in the direction to provide the pressure belt 120 with tension. Thus, the steering roller 122 remains pressed in the direction to keep the pressure roller 122 tensioned, whereby the pressure belt 120 always remains under 200 N of tensional force, for example.

The left supporting arm 126L is solidly attached to the bottom left plate 140L. The right supporting arm 126R is pivotally supported by the bottom right plate 140R. More specifically, the lengthwise end of the right supporting arm 126R is pivotally supported by a shaft 107 (pivot) attached to the bottom right plate 140R. Thus, the right supporting arm 126R is allowed to vertically pivot about the shaft 107 (pivot). Further, the opposite end of the shaft 107 from the right support arm 126R is fitted with a sector gear 108, which is in engagement with a worm gear 109 rotatable by a stepping motor 110, The motor 110 is solidly attached to the bottom right plate 140R.

The motor 110 can be controlled by the control portion 20 so that it rotates forward or in reverse. Thus, as the motor 110 is rotated in the forward or in reverse by the control portion 20, the right supporting arm 126R is pivotally moved about the shaft 107 upward or downward by the force conveyed thereto from the motor 110 by way of the worm gear 109 and sector gear 108. That is, the right bearing 106R, by which the right end portion 122*a*R of the shaft 122 of the steering roller 122 is borne, is moved upward or downward.

Thus, the steering roller 122 is pivotally moved upward or downward, about the left bearing 106L, by which the end portion 121*a*L of the shaft 121*a* of the steering roller 122 is borne. Consequently, the steering roller 122, which functions as an oscillatory roller, is changed in its attitude relative to the pressure roller 121. It is by this oscillatory movement of the steering roller 122 that the lateral shift of the pressure belt 120, that is, the movement of the pressure belt 120 in the direction parallel to the axial line of the pressure roller 120 (belt supporting member), which occurs while the pressure belt 120 is circularly moved, is controlled.

To describe in more detail, referring to FIG. 5, the pressure belt unit 100B also is provided with a belt shift sensor (which is similar to sensor shown in FIG. 5) for detecting the position of the pressure belt 120 in terms of the direction perpendicular to the circular movement of the pressure belt 120. The belt shift sensor is in the adjacencies of the right end portion (front end portion) of the pressure belt 120. The control portion 20 detects the position of one of the lateral edges of the pressure belt 120 with the use of this sensor, and controls the fixation belt 130 in position in terms of the direction perpendicular to the circular movement of the pressure belt 120. More specifically, the control portion 20 controls the pressure belt 120 in position by changing the steering roller 122 in angle by rotating the motor 110.

(2-5) Discharging Member

As described above, if the surface of the fixation belt 130 or pressure belt 120, with which the sheet S of recording medium comes into contact, is nonuniform in potential level, the toner on a sheet S of recording medium sometimes moves in the pattern of the nonuniformity of the potential level of the fixation belt 130, which results in the formation of an image which is abnormal in density. This is why the fixation belt unit 100A is provided with the aforementioned discharging needle 170 for discharging the surface of the fixation belt 130, which comes into contact with the sheet S of recording medium, in order to make the surface uniform in potential level. Further, the pressure belt unit 100B is provided with the aforementioned discharging needle 164 for discharging the surface of the pressure belt 120, with which the sheet S comes into contact, in order to make the surface uniform in potential level.

The discharging members 170 and 164 in this embodiment are in the form of a needle (discharging needle array), which are positioned in the adjacencies of the fixation belt 130 and pressure belt 120, respectively. The discharging members 170 and 164 are of the non-contact type, and extend in the widthwise direction of the corresponding belts. In order to ensure that the discharging members 170 and 164 are uniform in effectiveness in terms of its lengthwise direction, it is desired that the fixation belt unit 100A and pressure belt unit 100B are structured so that a preset amount of gap g (FIG. 1) is maintained between the discharging members 170 and 164, and the fixation belt 130 and pressure belt 120, respectively, which are the objects to be discharged.

In the case of the fixing device A designed so that its fixation belt 130 and pressure belt 120 are controlled in their lateral shift, the track of the fixation belt 130 of the fixation belt unit 100A and the track of the pressure belt 120 of the pressure belt unit 100B, change in position in response to the changes in the angle of the steering rollers 132 and 122, respectively, although the portion of the track of the fixation belt 130, which corresponds in position to the driver roller 131, and the portion of the track of the pressure belt 120, which corresponds in position to the pressure roller 121, do not change in position.

Figure 7:
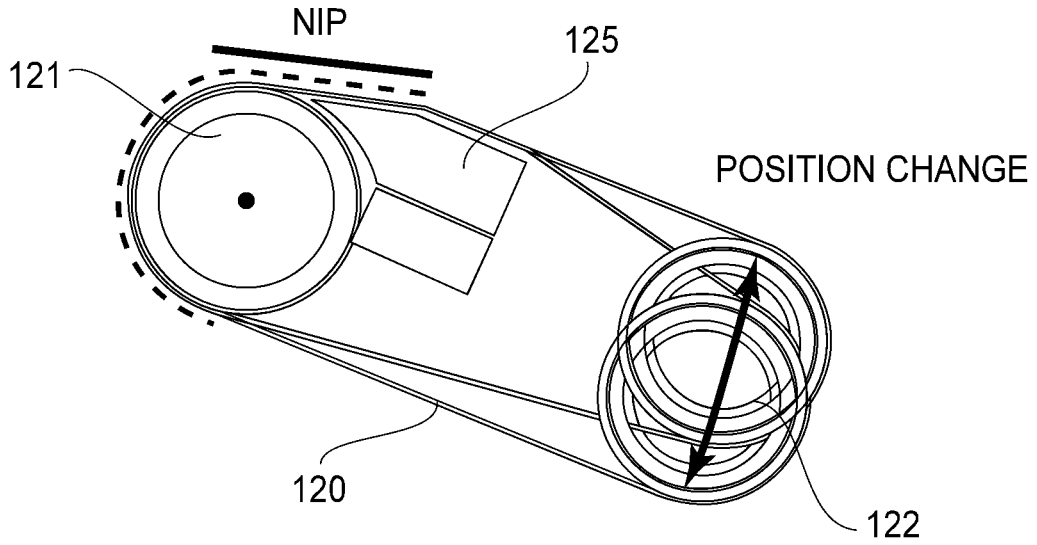
FIG. 7 is a drawing for showing the change in the belt position of the pressure belt unit caused by the belt shift control.

FIG. 7 is a drawing for describing the pressure belt unit 100B. The area indicated by a broken line in FIG. 7, is the area in which the track of the pressure belt 120 does not change in position in response to the changes in the angle of the steering roller 122. Thus, the thermistor (unshown) for detecting the belt temperature, and the separation guide (unshown), are positioned so that the positional relationship between the pressure roller 121 or driver roller 131 is unchanged.

Figure 8:
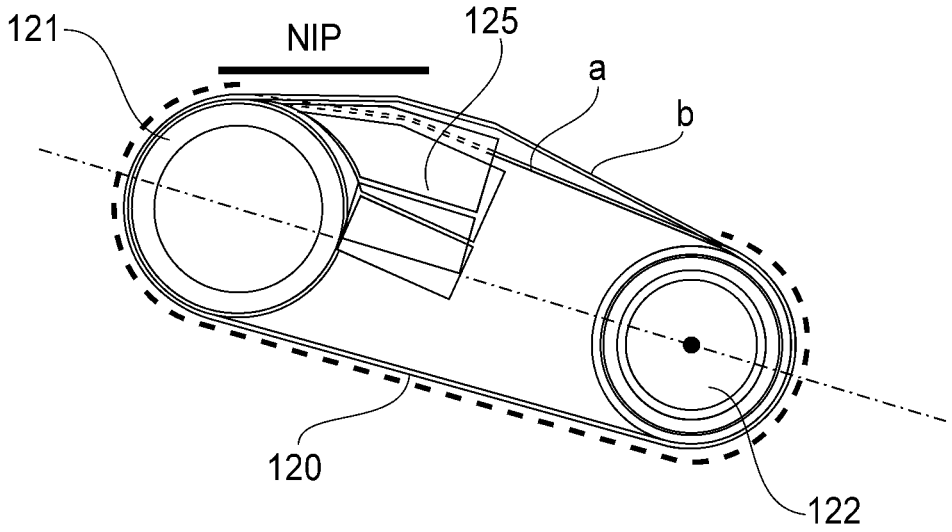
FIG. 8 is a drawing which shows the change in the belt position of the pressure belt unit as seen from the steering roller side.

Further, the track of the fixation belt 130, as seen from the side of the members of the fixation belt unit 100A, which move with the steering roller 132, hardly changes in position relative to the roller of the pressure belt unit 100B, which opposes the steering roller 132. The belt track changes in position in the area in which the fixation belt 130 is in contact with the fixation belt unit members which contribute to the formation of the fixation nip N. FIG. 8 is a drawing for describing the pressure belt unit 100B. The belt track changes in position in a range between the belt tracks indicated by referential codes a and b.

It is desired that the discharging members 170 and 164 are placed in an area in which rollers and metallic components are not present on the opposite side of the fixation belt 130 and pressure belt 120 from the discharging members 170 and 164, respectively.

The characteristic feature of this embodiment is that the discharging members 170 and 164 are held to the steering roller 132 and 122, which are oscillatory members, and also, that they move with the steering rollers 132 and 122, respectively. Therefore, the preset amount of gap between the belts 130 and 120, and the discharging member 170 and 164, respectively, can be maintained without using the limited space available in the adjacencies of the fixation nip N. Further, the belts 130 and 120 can be discharged without requiring that the metallic components such as rollers, laminar plates, etc., are positioned in a manner to oppose the discharging members 170 and 164. In other words, this embodiment of the present invention makes it possible to satisfactorily discharge the belts 130 and 120 by expertly using the limit space available in the adjacencies of the fixation nip N.

Figure 9:
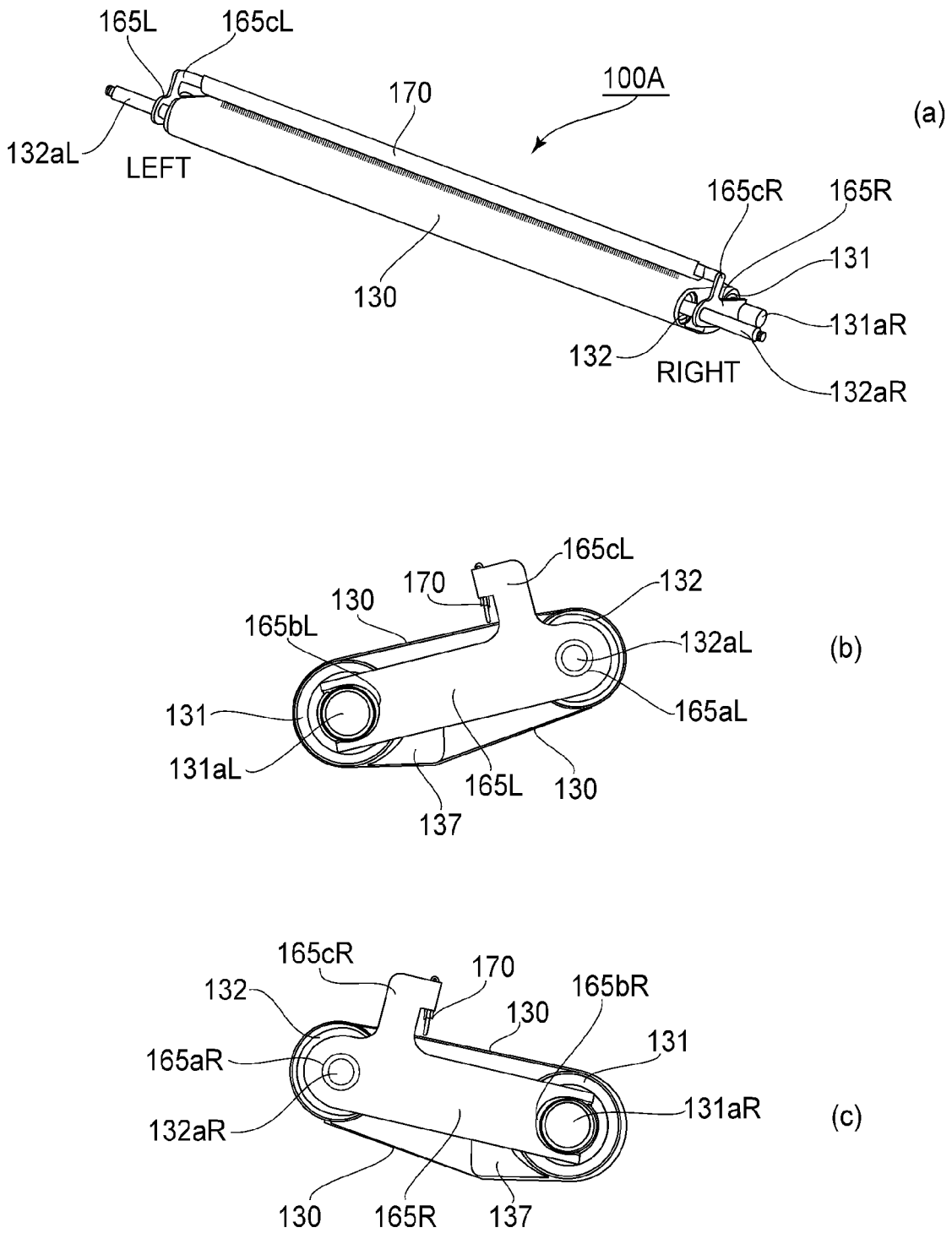
FIG. 9 is a drawing for describing the mechanism of the fixation belt unit, which holds the discharging member of the fixation belt unit.

1) Positioning and Structure of Discharging Member of Fixation Belt Unit 100A FIG. 9(*a*) is a perspective view of the discharging member of the fixation belt unit 100A, and shows the positioning and structure of the discharging member. FIGS. 9(*b*) and 9(*c*) are plan views of the left and right ends, respectively, of the fixation belt unit 100A.

The fixation belt unit 100A is provided with left and right members 165L and 165R, which function as the members for holding the discharging member 170. The discharging member supporting members 165L and 165R are attached to the left and right ends, respectively, of the fixation belt unit 100A, and are symmetrically positioned. The left and right members 165L and 165R are long and narrow pieces of plate, one for one, the lengthwise direction of which is parallel to the recording medium conveyance direction. They are long enough to cover the area between the shaft of the driver roller 131 and the shaft of the steering roller 132, and slightly beyond the area.

The end portion of the left supporting member 165L, which corresponds in position to the steering roller 132, is provided with a round hole 165*a*L, in which the left end portion 132*a*L of the shaft 132*a* of the steering roller 132 is fitted. The end portion of the left supporting member 165L, which corresponds in position to the driver roller 131, is shaped like a two-pronged fork (forked portion 165*b*L, which may be elongated hole). The left end portion 131*a*L of the shaft 131*a* of the driver roller 131 is fitted in the gap between the two-prongs of the forked portion 165*b*L.

That is, the left supporting member 165L is supported by the left end portion 131*a*L of the shaft 131*a* of the driver roller 131, and left end portion 132*a*L of the shaft 132*a* of the steering roller 132, in such a manner that it is allowed to pivot about the left end portion 132*a*L of the shaft 132*a* of the steering roller 132 in an oscillatory manner. Further, the left supporting member 165L is provided with an arm portion 165*c*L, which extends upward from the portion of the main portion of the left supporting member 165L, which is adjacent to the steering roller 132.

The end portion of the right supporting member 165R, which corresponds in position to the steering roller 132, is provided with a round hole 165*a*R, in which the right end portion 132*a*R of the shaft 132*a* of the steering roller 132 is fitted. The end portion of the right supporting member 165R, which corresponds in position to the driver roller 131, is shaped like a two-pronged fork (forked portion 165*b*R, which may be elongated hole). The right end portion 131*a*R of the shaft 131*a* of the driver roller 131 is fitted in the gap between the two-prongs of the forked portion 165*b*R.

That is, the right supporting member 165R is supported by the right end portion 131*a*R of the shaft 131*a* of the driver roller 131, and right end portion 132*a*R of the shaft 132*a* of the steering roller 132, in such a manner that it is allowed to pivot about the right end portion 132*a*R of the shaft 132*a* of the steering roller 132 in an oscillatory manner. Further, the right supporting member 165R is provided with an arm portion 165*c*R, which extends upward from the portion of the main portion of the right supporting member 165R, which is adjacent to the steering roller 132.

The aforementioned discharging member 170 (discharge needle array) is held between the upwardly extending arm portion 165*c*L of the left supporting member 165L and the upwardly extending arm portion 165*c*R of the right supporting member 165R. That is, the discharging member 170 is held so that it extends in the widthwise direction of the fixation belt 130, in parallel to the steering roller 132, with the presence of a preset amount of gap g (FIG. 1) between itself and fixation belt 130. That is, the discharging member 170 is parallel to the steering roller 132, and its distance from the steering roller 132 is within 20 mm. It is positioned so that there is no object within the belt loop, that opposes the discharging member across the fixation belt 130.

The fixation belt unit 100A may be provided with a member which connects the upward arm portion 165*c*L of the left supporting member 165L and the upward arm portion 15*c*R of the right supporting member 165R, so that the discharging member 170 can be attached to the connective member.

With the fixation belt unit 100A being structured as described above, the discharging member 170 is held to the steering roller 132, which is an oscillatory member. Thus, it moves with the steering roller 132. Therefore, the preset amount of gap g can be maintained between the discharging member 170 and fixation belt 130 without using the limited space available in the adjacencies of the fixation nip N, and also, it is possible to discharge the fixation belt 130 without requiring that the mechanical component such as a roller, a laminar plate, or the like, is placed on the inward side of the belt loop in a manner to oppose the discharging member 170. Therefore, the fixation belt 170 can be satisfactorily discharged while expertly utilizing the limited space available in the fixation belt unit 100A.

Figure 10:
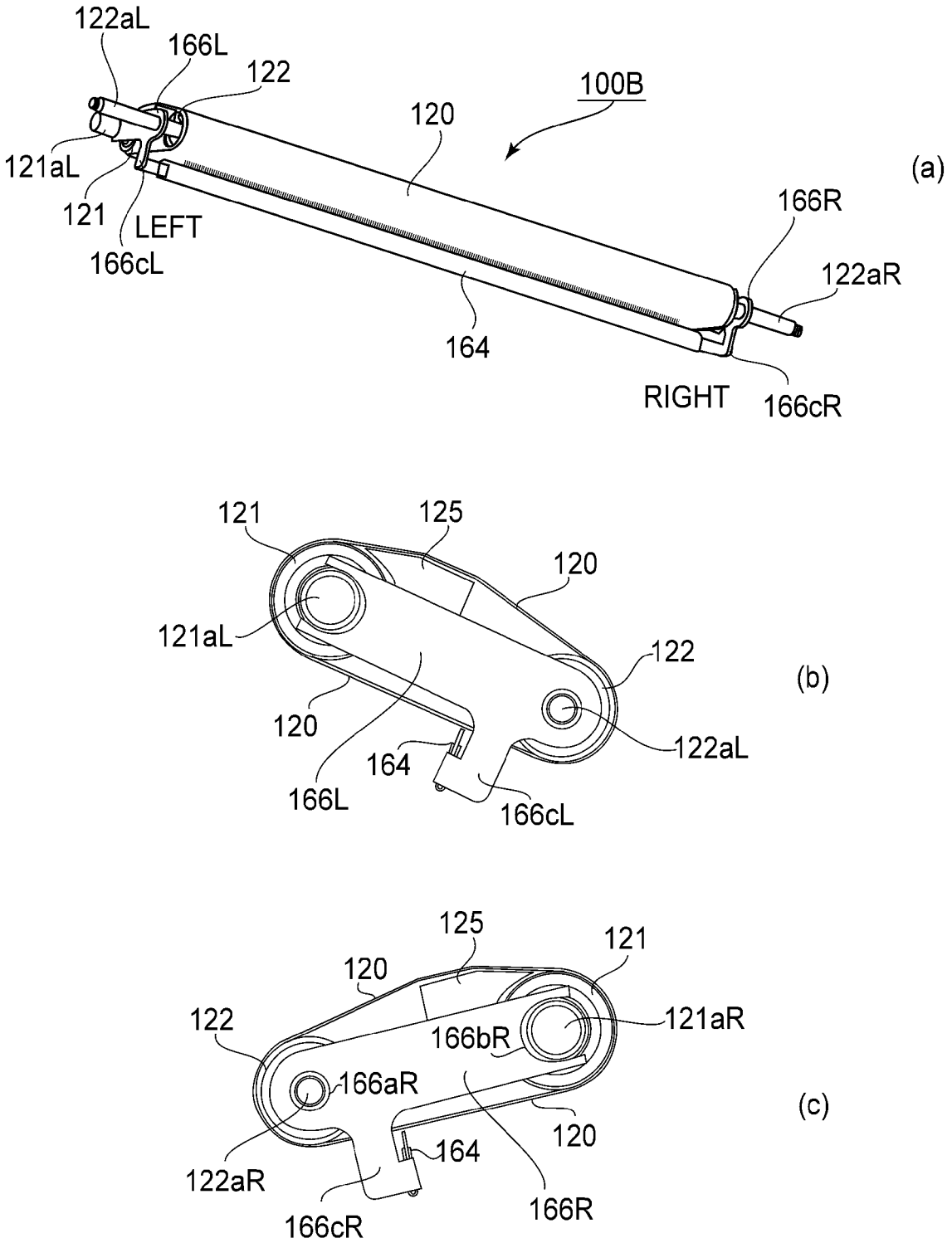
FIG. 10 is a drawing for describing the mechanism of the pressure belt unit, which holds the discharging member of the pressure belt unit.

2) Positioning and Structure of Discharging Member of Pressure Belt Unit 100B FIG. 10(*a*) is a perspective view of the discharging member of the pressure belt unit 100B, and shows the positioning and structure of the discharging member. FIGS. 10(*b*) and 10(*c*) are plan views of the left and right ends, respectively, of the pressure belt unit 100B.

The pressure belt unit 100B is provided with left and right members 166L and 166R, which function as the members for holding the discharging member 164. The discharging member holding members 166L and 166R are attached to the left and right ends, respectively, of the pressure belt unit 100B, and are symmetrically positioned. The left and right members 166L and 166R are long and narrow pieces of plate, one for one, the lengthwise direction of which is parallel to the recording medium conveyance direction. They are long enough to cover the area between the shaft of the pressure roller 121 and the shaft of the steering roller 122, and slightly beyond the area.

The end portion of the left supporting member 166L, which corresponds in position to the steering roller 122, is provided with a round hole 166*a*L, in which the left end portion 122*a*L of the shaft 122*a* of the steering roller 122 is fitted. The end portion of the left supporting member 166L, which corresponds in position to the pressure roller 121, is shaped like a two-pronged fork (forked portion 166*b*L, which may be elongated hole). The left end portion 121*a*L of the shaft 121*a* of the pressure roller 121 is fitted in the gap between the two-prongs of the forked portion 166*b*L.

That is, the left supporting member 166L is supported by the left end portion 121*a*L of the shaft 121*a* of the pressure roller 121, and the left end portion 122*a*L of the shaft 122*a* of the steering roller 122, in such a manner that it is allowed to pivot about the left end portion 122*a*L of the shaft 122*a* of the steering roller 122 in an oscillatory manner. Further, the left supporting member 166L is provided with an arm portion 166*c*L, which extends upward from the portion of the main portion of the left supporting member 166L, which is adjacent to the steering roller 122.

The end portion of the right supporting member 166R, which corresponds in position to the steering roller 122, is provided with a round hole 166*a*R, in which the right end portion 122*a*R of the shaft 122*a* of the steering roller 122 is fitted. The end portion of the right supporting member 166R, which corresponds in position to the pressure roller 121, is shaped like a two-pronged fork (forked portion 166*b*R, which may be elongated hole). The right end portion 121*a*R of the shaft 121*a* of the pressure roller 121 is fitted in the gap between the two-prongs of the forked portion 166*b*R.

That is, the right supporting member 166R is supported by the right end portion 121*a*R of the shaft 121*a* of the pressure roller 121, and the right end portion 122*a*R of the shaft 122*a* of the steering roller 122, in such a manner that it is allowed to pivot about the right end portion 122*a*R of the shaft 122*a* of the steering roller 122 in an oscillatory manner. Further, the right supporting member 166R is provided with an arm portion 166*c*R, which extends downward from the portion of the main portion of the right supporting member 166R, which is adjacent to the steering roller 122.

The aforementioned discharging member 164 (discharge needle array) is held between the downwardly extending arm portion 166*c*L of the left supporting member 166L and the downwardly extending arm portion 166*c*R of the right supporting member 166R. That is, the discharging member 164 is held so that it extends in the widthwise direction of the pressure belt 120, in parallel to the steering roller 122, with the presence of a preset amount of gap g (FIG. 1) between itself and pressure belt 120. That is, the discharging member 164 is parallel to the steering roller 122, and its distance from the steering roller 122 is within 20 mm. It is positioned so that there is no object within the belt loop, that opposes the discharging member164 across the pressure belt 120.

The pressure belt unit 100B may be structured so that it is provided with a member which connects the downward arm portion 166*c*L of the left supporting member 166L and the downward arm portion 166*c*R of the right supporting member 166R, and the discharging member 164 is attached to the connective member.

With the pressure belt unit 100B being structured as described above, the discharging member 164 is held to the steering roller 122, which is an oscillatory member. Thus, it moves with the steering roller 122. Therefore, the preset amount of gap g can be maintained between the discharging member 164 and pressure belt 120 without using the limited space available in the adjacencies of the fixation nip N, and also, it is possible to discharge the pressure belt 120 without requiring the mechanical component such as a roller, a laminar plate, or the like, to be placed on the inward side of the belt loop in a manner to oppose the discharging member 164. Therefore, the fixation belt 164 can be satisfactorily discharged while expertly utilizing the limited space available in the pressure belt unit 100B.

[Embodiment 2]

Figure 11:
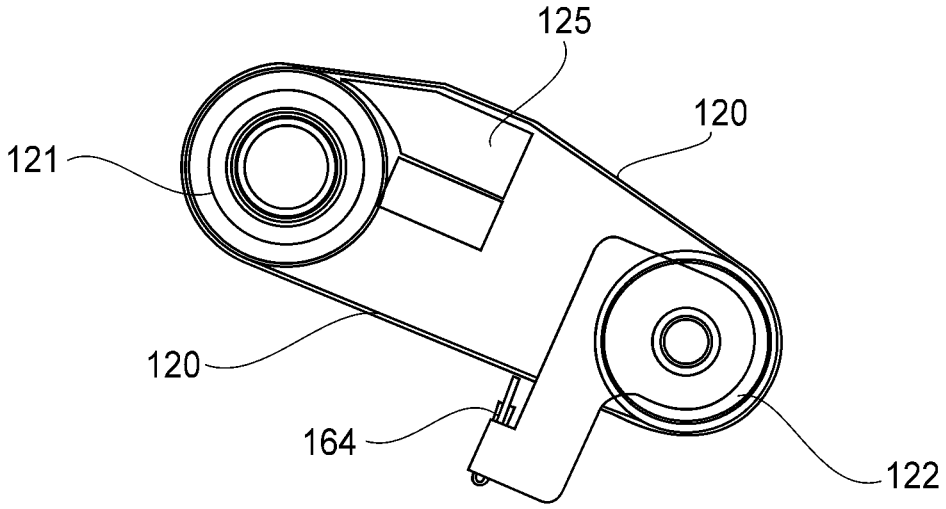
FIG. 11 is a drawing of the discharging member holding mechanism (of pressure belt unit) in the second embodiment of the present invention.
Figure 16:
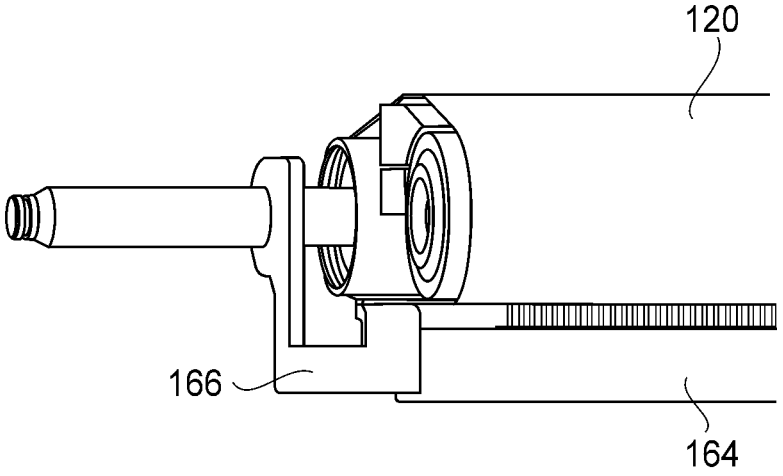
FIG. 16 is a drawing for describing in more detail the structure of the mechanism for holding the discharging member, shown in FIG. 11.

FIG. 11 is a drawing of the mechanism, in the second embodiment of the present invention, for holding a discharging member (of pressure belt unit). Hereafter, the discharging member holding mechanism in the second embodiment is described with reference to the pressure belt unit 100B, for the sake of convenience. The description of the discharging member holding mechanism of the fixation belt unit 100A is similar to that of the discharging member holding mechanism of the pressure roller unit 100B. FIG. 11 does not show the portions of the mechanism, which are not essential to the description of the second embodiment. That is, it shows only the portion of the mechanism, at which the discharging member holding member is placed in contact with the belt to prevent the discharging member holding member from being rotationally moved. Referring to FIG. 16, the discharging member holding member 166 is enabled to maintain a preset amount of gap between the discharging member 164 and belt 120 (130), by the contact between itself and belt 120, or the contact between a member held to (by) the discharging member holding member 166 and the belt 120.

Figure 12:
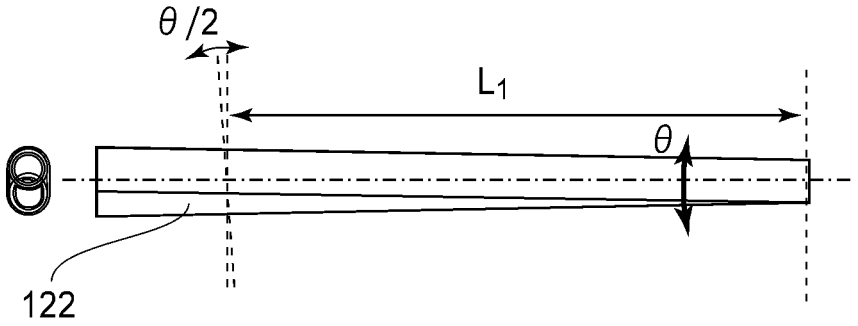
FIG. 12 is a drawing which shows the movement of the steering roller (of pressure belt unit) caused by the belt shift control, in the second embodiment.
Figure 13:
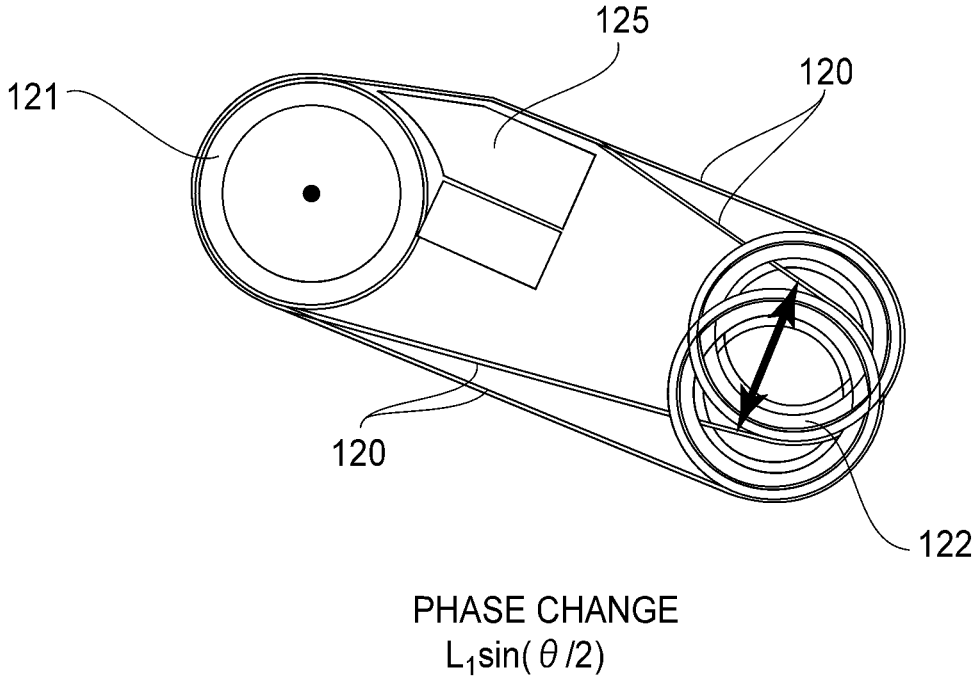
FIG. 13 is a sectional view of the pressure belt unit in the second embodiment, which shows the twisting of the belt caused by the belt shift control.

In a case where the discharging member 164 is positioned in parallel to the steering roller 122, the steering roller 122 moves as shown in FIG. 13 when the belt 120 is controlled in its lateral movement. Therefore, the steering roller 122, by which the pressure belt 120 is suspended at its opposite end from where it is suspended by the pressure roller 121, becomes angled relative to the pressure roller 121 as shown in FIG. 12. Thus, the pressure belt 120 becomes twisted relative to the surface which is parallel to the pressure roller 121, and the surface which is parallel to the steering roller 122. Referring to FIG. 12, "A" stands for the angle of the steering roller 122 relative to the pressure roller 121, which suspends, and keeps tensioned, the pressure belt 120 at the opposite end of the pressure belt 120 from where the pressure belt 120 is suspended by the pressure roller 121. "L1" stands for the width (dimension in terms of direction parallel to axial line of pressure roller 121) of the pressure roller 121, and "L2" stands for the amount of gap between the steering roller 122 and discharging member 164. Further, "L3" stands for the distance between the steering roller 122, and the pressure roller 121 which suspends, and keeps tensioned, the pressure belt 120 at the opposite end of the belt loop from where the pressure belt 120 is suspended by the steering roller 122.

Figure 14:
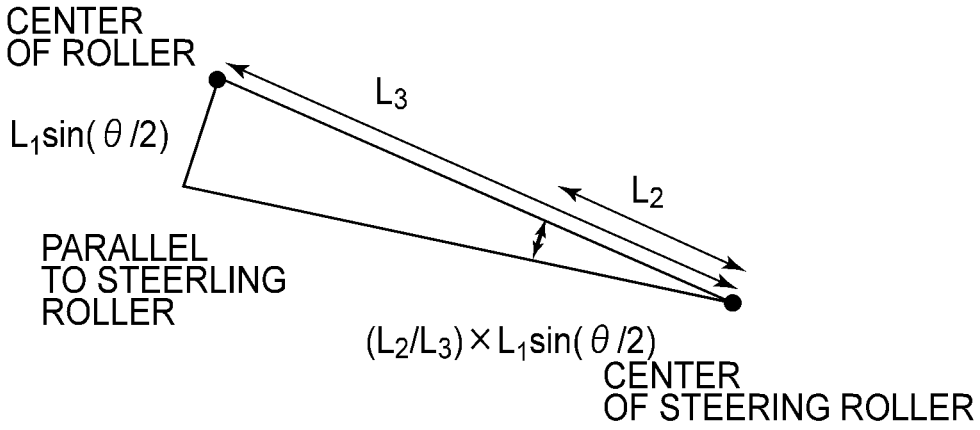
FIG. 14 is a schematic drawing which shows the change in the amount of gap between the belt and discharging member (of the pressure belt unit) in the second embodiment.

The amount of difference in phase (FIG. 13) between the steering roller 122, and the pressure roller 121 which suspends, and keeps tensioned the pressure roller 120 at the opposite end of the belt loop from where the pressure belt 120 is suspended by the steering roller 122 is $L1 \cdot \sin(\theta/2)$. Next, referring to FIG. 14 which is a schematic drawing for showing the changes in the amount of gap between the discharging member 164 and pressure belt 120, the changes which occurs in the amount of the gap between the discharging member 164 and pressure belt 120 can be expressed as $(L2/L3) \times L1 \cdot \sin(\theta/2)$.

For example, when the angle θ by which the steering roller 121 pivots is 0.8 [degrees], and the amount of gap to be maintained between the discharging member 164 and steering roller 122 is ±0.25, the value of (L2/L3) which is obtainable by substituting actual values for L1, L2, L3, and θ in the mathematical formula given above is roughly 0.19, since the belt width in this embodiment is 380 mm.

If the distance L3 between the steering roller 122, and the pressure roller 121 by which the pressure belt 120 is suspended, and kept tensioned, at the opposite end of the belt loop from where the pressure belt 120 is suspended by the steering roller 122 is 50 mm, the discharging member 164 is desired to be positioned no more than 9.4 mm away from the steering roller 122.

In this embodiment, the pressure belt 120, which is to be discharged, is in a range of 500-1,000 V in potential level. Therefore, the amount of the gap g between the discharging member 164 and steering roller 122 is desired to be kept within roughly ±0.5. In consideration of this requirement, the proper position for the discharging member 164 is no more than roughly 20 mm from the steering roller 122 in terms of the moving direction of the pressure belt 120.

Up to this point, the present invention has been described with reference to the fixing devices in two embodiments of the present invention. However, the present invention is also applicable to various known fixing devices which are different in structure from those in the preceding embodiments, within the gist of the present invention.

For example, in the preceding embodiments, the fixing member and pressing member which form the nip N are both endless belts. However, the present invention is also applicable to a fixing device and the like which uses a roller as either the fixing member or pressing member.

Further, the present invention is also applicable to a fixing device and the like which uses a belt as its fixing member, and a nonrotational member such as a pad or flat plate which is small in surface friction (relative to fixation belt and sheet of recording medium), as its pressing member.

Further, the preceding embodiments are not intended to limit the present invention in terms of the heating system for heating the endless belts. That is, not only is the present invention applicable to a fixing device and the like which employs an electromagnetic induction heating system to heat the belts, but also, a fixing device and the like which uses other heating system, such as a halogen heater, than an electromagnetic induction heating system.

Further, in the description of the preceding embodiments, the fixing device was described as an image heating device. However, the present invention is also applicable to a device (apparatus) which is for reheating a fixed image on a sheet of recording medium to improve the image in surface properties.

Further, not only is the present invention compatible with an image forming apparatus which uses the above described electrophotographic image formation system, as the method for forming a toner image on a sheet of recording medium, but also, an image forming apparatus which uses an electrostatic recording system or a magnetic recording system.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 098677/2012 filed Apr. 24, 2012, which is hereby incorporated by reference.

What is claimed is:

1. An image heating apparatus comprising:

a rotatable member and a rotatable endless belt configured to form a nip portion for heating an image on a sheet therebetween;

a first roller configured to rotatably support an inner surface of said endless belt;

a second roller configured to rotatably support the inner surface of said endless belt;

a detector configured to detect that said endless belt is beyond a predetermined zone in an widthwise direction of said endless belt;

a displacing mechanism configured to displace said first roller relative to said second roller based on an output of said detector so as to maintain said endless belt within the predetermined zone in the widthwise direction;

an electrical discharging member configured to electrically discharge said endless belt; and a holder configured to hold said electrical discharging member, wherein said holder is held on both end portions of said first roller in an axis direction of said first roller so as to be displaced together with said first roller displaced by said displacing mechanism so that said electrical discharging member is disposed at a predetermined distance from an outer surface of said endless belt.

2. An apparatus according to claim 1, wherein said electrical discharging member includes a discharging needle extending in the widthwise direction.

3. An apparatus according to claim 1, wherein said endless belt is disposed so as to contact to a surface of the sheet opposite to a surface of the sheet on which the image is formed.

* * * * *